US005737672A

United States Patent [19]

Denton et al.

[11] Patent Number: 5,737,672

[45] Date of Patent: Apr. 7, 1998

[54] SELF-CLEANING LIQUID DEVELOPING MATERIAL APPLICATOR

[75] Inventors: Gary A. Denton, Lexington, Ky.; Paul W. Morehouse, Jr., Webster; John M. Simpson, III, Churchville, both of N.Y.

[73] Assignee: Xerox Corporation, Stamford, Conn.

[21] Appl. No.: 535,429

[22] Filed: Sep. 28, 1995

[51] Int. Cl.[6] ..... G03G 15/10

[52] U.S. Cl. ..... 399/240; 399/245

[58] Field of Search ..... 355/256–258; 118/659, 660, 652; 399/233, 245, 239, 247, 240

[56] References Cited

U.S. PATENT DOCUMENTS

| | | | |
|---|---|---|---|
| 4,627,705 | 12/1986 | Landa et al. | 355/256 |
| 4,796,051 | 1/1989 | Monkelbaan et al. | 355/256 |
| 4,799,452 | 1/1989 | Day | 118/660 X |
| 4,800,839 | 1/1989 | Ariyama et al. | 118/691 |
| 4,883,018 | 11/1989 | Sagiv | 399/105 |
| 4,895,103 | 1/1990 | Day | 118/652 |
| 4,987,429 | 1/1991 | Finley et al. | 355/256 |
| 5,404,210 | 4/1995 | Day | 355/256 |
| 5,519,473 | 5/1996 | Morehouse, Jr. et al. | 355/256 |

*Primary Examiner*—Robert Beatty
*Attorney, Agent, or Firm*—Lloyd F. Bean, II

[57] ABSTRACT

An apparatus for developing an electrostatic latent image on an imaging member with a liquid developing material, including a liquid developing material applicator, the housing defining an aperture adapted for transporting liquid developing material into contact with the imaging member, the housing further including a planar surface adjacent the aperture for providing a liquid developing material application region in which the liquid developing material can flow freely with the imaging member; a developing roll situated adjacent the liquid developing material applicator and downstream therefrom relative to a path of travel of the imaging member; and a cleaning system, operatively coupled to the liquid developing material applicator, for cleaning residue liquid developer material from the liquid developing material applicator and the developing roll.

1 Claim, 2 Drawing Sheets

SELF-CLEANING LIQUID DEVELOPING MATERIAL APPLICATOR

This invention relates generally to an electrostatographic printing machine, and more particularly concerns an apparatus for applying a liquid developer material to a latent image bearing surface such as a photoreceptive member in a xerographic copying or printing machine.

Generally, the process of electrostatographic copying is initiated by exposing a light image of an original document to a substantially uniformly charged photoreceptive member. Exposing the charged photoreceptive member to a light image discharges the photoconductive surface thereof in areas corresponding to non-image areas in the original input document while maintaining the charge in image areas, resulting in the creation of an electrostatic latent image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a powder toner image on the photoreceptive member. Alternatively, liquid developer materials comprising a liquid carrier material having toner particles dispersed therein have been utilized, wherein the liquid developer material is applied to the latent image with the toner particles being attracted toward the image areas to form a liquid image. Regardless of the type of developer material employed, the toner particles of the developed image are subsequently transferred from the photoreceptive member to a copy sheet, either directly or by way of an intermediate transfer member. Once on the copy sheet, the image may be permanently affixed to provide a "hard copy" reproduction of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, in contradistinction to the light lens generated image systems which develop toner on the charged areas, knows as CAD, or "write white" systems. The subject invention applies to both such systems.

The use of liquid developer materials in imaging processes is well known. Likewise, the art of developing electrostatographic latent images formed on a photoconductive surface with liquid developer materials is also well known. Indeed, various types of liquid developing material development systems have heretofore been disclosed.

Liquid developers have many advantages, and often produce images of higher quality than images formed with dry toners. For example, images developed with liquid developers can be made to adhere to paper without a fixing or fusing step, thereby eliminating a requirement to include a resin in the liquid developer for fusing purposes. In addition, the toner particles can be made to be very small without resulting in problems often associated with small particle powder toners, such as airborne contamination which can adversely affect machine reliability and can create potential health hazards. Development with liquid developers in full color imaging processes also has many advantages, including, among others, production of a texturally attractive output document due to minimal multilayer toner height build-up (whereas full color images developed with dry toners often exhibit substantial height build-up of the image in regions where color areas overlap). In addition, full color imaging with liquid developers is economically attractive, particularly if surplus liquid carrier containing the toner particles can be economically recovered without cross contamination of colorants. Further, full color prints made with liquid developers can be processed to a substantially uniform finish, whereas uniformity of finish is difficult to achieve with powder toners due to variations in the toner pile height as well as a need for thermal fusion, among other factors.

Although specific liquid development systems may vary, one well known type of system includes a roll member adapted to transport liquid developer material into a position proximate to the photoconductive surface such that the electrostatic latent image recorded thereon can attract the liquid developer material in image configuration. In such systems, the roll member is typically partly submerged in a sump of liquid developer material with the roll member being rotated at a sufficiently high velocity so as to transport the liquid developer to the surface of the photoreceptor in the form of a thin toner film formed along the surface of the roll member. In addition, an electrical field is generally induced across a gap between the photoconductive surface and the roll member by applying an electrical bias to the roll member for maintaining a toning meniscus across the gap to provide a desired density of toner particles entrained in the liquid developer and to reduce undesirable background staining of the photoreceptor as it passes the developer apparatus.

Generally, in the field of electrostatographic printing and copying, development of a latent image takes place at high speeds, which requires that a large amount of uniformly characteristic liquid developer material be supplied to the photoconductive surface as uniformly as possible to produce a high quality image without any variations in the development thereof.

When a liquid ink developer development subsystem is turned off at the end of a print cycle, some ink may remain on the applicator surface adjacent the photoreceptor. If the machine is turned off for several hours, the carrier fluid may eventually leave this surface due to gravity and evaporation, depositing a persistent layer of toner on this surface. Over a period of time, enough toner may accumulate on this surface to significantly affect the amount of ink applied to the photoreceptor. It is also possible that some of the deposited toner may become dislodged from this surface and move to the development nip where it could cause an image defect. While the applicator surface may be cleaned by a service rep or machine operator at regular intervals, it is more desirable to have the applicator clean itself.

In accordance with one aspect of the present invention, there is provided a liquid developing material applicator, including a housing, said housing defining an aperture adapted for transporting liquid developing material into contact with an image bearing surface; and a cleaning system, operatively coupled to the liquid developing material applicator, for cleaning residue liquid developer material therefrom.

In accordance with another aspect of the present invention, an apparatus for developing an electrostatic latent image on an imaging member with a liquid developing material, including a liquid developing material applicator, said housing defining an aperture adapted for transporting liquid developing material into contact with the imaging member, said housing further including a planar surface adjacent the aperture for providing a liquid developing material application region in which the liquid developing material can flow freely with the imaging member; a developing roll situated adjacent said liquid developing material applicator and downstream therefrom relative to a path of travel of the imaging member; and a cleaning system, operatively coupled to the liquid developing material applicator, for cleaning residue liquid developer material from said liquid developing material applicator and said developing roll.

An object of the present invention is to accomplish this by shutting off the flow of ink to the applicator and pumping a small of clear carrier fluid through the applicator during cycle out. This should effectively flush most of the ink from the applicator and greatly reduce the amount of toner left to dry on the applicator surface. The wash of clear carrier fluid over the metering roll cleaning blade may also help to reduce the accumulation of toner sludge on that member. This may also result in fewer required service actions to remove these deposits. And as before, this may improve the stability of the print quality.

Other aspects of the present invention will become apparent as the following description proceeds and upon reference to the drawings, in which.

Figure 2:
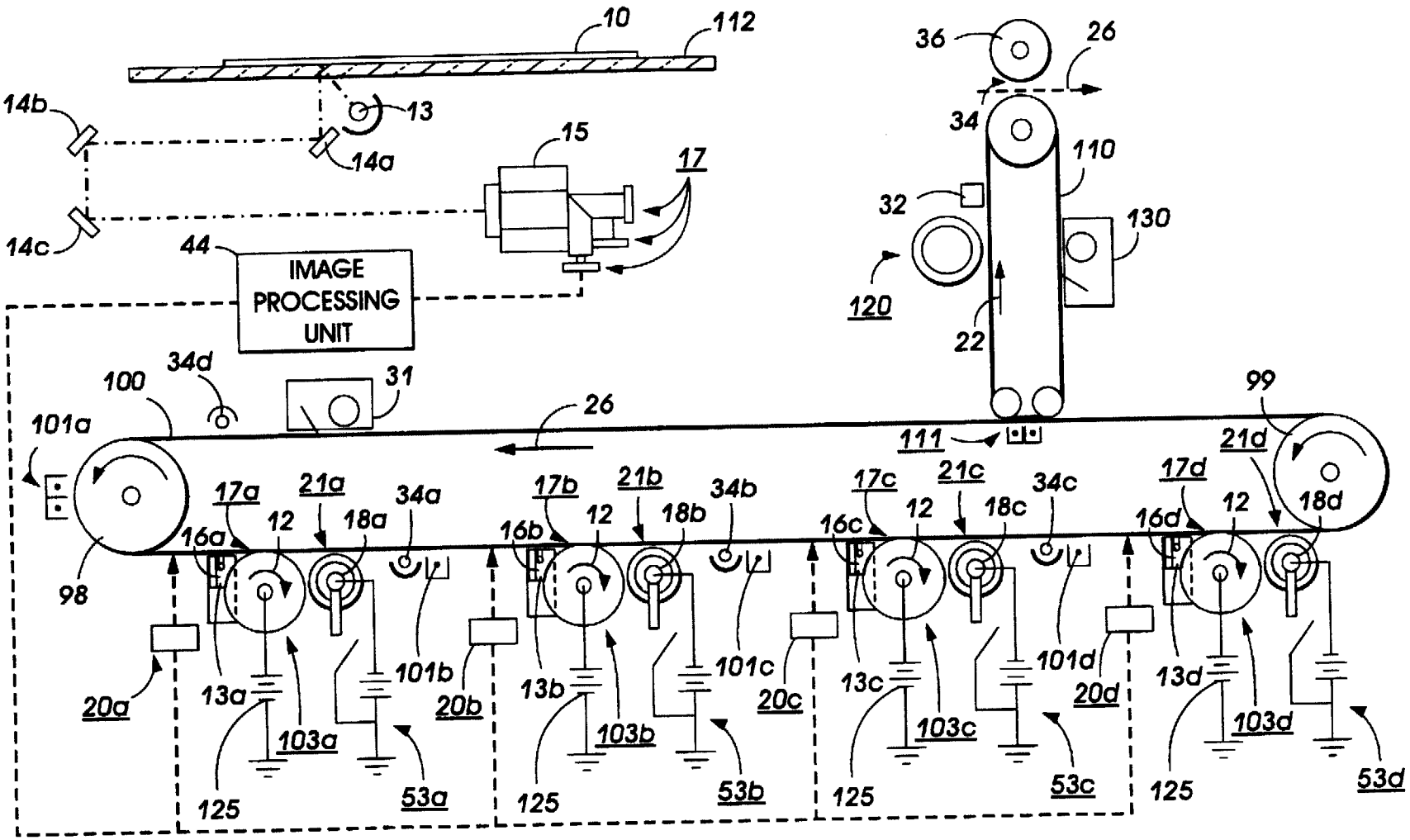
FIG. 2 is a schematic, elevational view of a color electrostatographic printing machine utilizing the liquid developing material applicator of the present invention.

For a general understanding of the features of the present invention, reference is made to the drawings, wherein like reference numerals have been used throughout to designate identical elements. FIG. 2 is a schematic elevational view illustrating a full-color liquid developing material based electrostatographic printing machine incorporating the features of the present invention. Inasmuch as the art of electrostatographic printing is well known, the various processing stations employed in the printing machine of FIG. 2 will be described briefly with reference thereto. It will become apparent from the following discussion that the apparatus of the present invention may be equally well suited for use in a wide variety of printing machines and is not necessarily limited in its application to the particular electrostatographic described herein. While the present invention will hereinafter be described in connection with a preferred embodiment thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 2, a photoreceptive member 100 is rotated along a curvilinear path defined by rollers 98 and 99. The photoreceptor 100 preferably includes a continuous multilayered belt including a substrate, a conductive layer, an optional adhesive layer, an optional hole blocking layer, a charge generating layer, a charge transport layer, and, in some embodiments, an anti-curl backing layer. Initially, belt 100 is charged to a uniform potential at a charging station by charging unit 101*a*, which typically includes a corona generating device capable of spraying ions onto the surface of the photoreceptive member 100 to produce a relatively high, substantially uniform charge thereon.

After a uniform charge is placed on the surface of the photoreceptive member 100, the electrostatographic printing process proceeds by either inputting a computer generated color image into an image processing unit 44 or, for example, by placing a color input document 10 to be copied on the surface of a transparent imaging platen 112. A scanning assembly preferably comprising a high powered light source 13, mirrors 14*a*, 14*b* and 14*c*, a series of lenses (not shown), a dichroic prism 15 and a plurality of charge-coupled devices (CCDs) 117 operating in association with one another is provided, whereby light from the light source 13 is directed onto the input document 10 with the light reflected from the color document 10 being transmitted to the CCDs 117. The reflected light is separated into the three primary colors by the dichroic prism 15 such that each CCD 117 provides an analog output voltage which is proportional to the intensity of the incident light of each of the primary colors. Thereafter, the analog signal from each CCD 117 is converted into a digital signal corresponding individual picture elements or so-called pixels making up the original input document. These digital signals, which represent the blue, green, and red density signals, are input into the image processing unit 44 where they are converted into individual bitmaps representing the colorant components of each pixel (yellow (Y), cyan (C), magenta (M), and black (Bk)), the respective values of exposure for each pixel, and the color separation therebetween. The image processing unit 44 can store bitmap information for subsequent images or can operate in a real time mode. The image processing unit 44 may also contain a shading correction unit, an undercolor removal unit (UCR), a masking unit, a dithering unit, a gray level processing unit, and other imaging processing subsystems known in the art.

The digital output signals generated by the image processing unit 44 described hereinabove are transmitted to a series of individual raster output scanners (ROSs) 20*a*, 20*b*, 20*c* and 20*d* for writing complementary color image bitmap information onto the charged photoreceptive belt 100 by selectively erasing charges thereon. Each ROS writes the image information in a pixel by pixel manner. It will be recognized that the present description is directed toward a Recharge, Expose, and Develop (READ) process, wherein the charged photoconductive surface of photoreceptive member 100 is serially exposed to record a series of latent images thereon corresponding to the subtractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD) discharged portions are developed, or charged area development (CAD), wherein charged areas are developed can be employed, as will be described.

As previously noted, the present invention is directed to the apparatus which is utilized for carrying out the development process utilizing liquid developer materials, such apparatus being depicted schematically at reference numerals 103a, 103b, 103c and 103d. Each developer unit transports a different color liquid developer material into contact with the electrostatic latent image so as to develop the latent image with pigmented toner particles to create a visible image. By way of example, developer unit 103a transports cyan colored liquid developer material, developer unit 103b transports magenta colored liquid developer material, developer unit 103c transports yellow colored liquid developer material, and developer unit 103d transports black colored liquid developer material. Each different color developer material comprises pigmented toner particles disseminated through a liquid carrier, wherein the toner particles are charged to a polarity opposite in polarity to the charged latent image on the photoconductive surface such that the toner particles pass by electrophoresis to the electrostatic latent image to create a visible developed image thereof. Each of the developer units 103a, 103b, 103c and 103d are substantially identical to one another and will be described hereinafter in greater detail with reference to FIGS. 1 and 2.

Generally, the liquid carrier medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures.

The toner particles can be any pigmented particle compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and U.S. application Ser. No. 08/268,608 the disclosures of each of which are totally incorporated herein by reference. The toner particles should have an average particle diameter from about 0.2 to about 10 microns, and preferably from about 0.5 to about 2 microns. The toner particles may be present in amounts of from about 1 to about 10 percent by weight, and preferably from about 1 to about 4 percent by weight of the developer composition. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer materials suitable for the present invention, a charge control additive sometimes referred to as a charge director may also be included for facilitating and maintaining a uniform charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

After image development, the liquid image on the photoconductor may be conditioned to compress the image and remove some of the liquid carrier therefrom, as shown, for example, by U.S. Pat. No. 4,286,039, among various other patents. An exemplary apparatus for image conditioning is shown at reference numeral 21a, 21b, 21c and 21d, each comprising a roller, similar to roller 18a which may include a porous body and a perforated skin covering. The roller 18a is typically biased to a potential having a polarity which inhibits the departure of toner particles from the image on the photoreceptor 100 while compacting the toner particles of the image onto the surface of the photoreceptive member. In this exemplary image conditioning system, a vacuum source (not shown) is also provided and coupled to the interior of the roller for creating an airflow through the porous roller body to draw liquid from the surface of the photoreceptor, thereby increasing the percentage of toner solids in the developed image. In operation, roller 18a rotates against the liquid image on belt 100 such that the porous body of roller 18a absorbs excess liquid from the surface of the image through the pores and perforations of the roller skin covering. The vacuum source, typically located along one end of a central cavity, draws liquid through the roller skin to a central cavity for depositing the liquid in a receptacle or some other location which permits either disposal or recirculation of the liquid carrier. The porous roller 18*a* is thus continuously discharged of excess liquid to provide continuous removal of liquid from the image on belt 100. It will be recognized by one of skill in the art that the vacuum assisted liquid absorbing roller described hereinabove may also find useful application in an embodiment in which the image conditioning system is provided in the form of a belt, whereby excess liquid carrier is absorbed through an absorbent foam layer in the belt, as described in U.S. Pat. Nos. 4,299,902 and 4,258,115.

After image conditioning of the first developed image, the image on belt 100 is advanced to a lamp 34*a* where any residual charge left on the photoreceptive surface is extinguished by flooding the photoconductive surface with light from lamp 34*a*. Thereafter, imaging and development are repeated for subsequent color separations by first recharging and reexposing the belt 100, whereby color image bitmap information is superimposed over the previous developed latent image. Preferably, for each subsequent exposure an adaptive exposure processor is employed that modulates the exposure level of the raster output scanner (ROS) for a given pixel as a function of the toner previously developed at the pixel site, thereby allowing toner layers to be made independent of each other, as described in U.S. application Ser. No. 07/927,751. The reexposed image is next advanced through a development station and subsequently through an image conditioning station and each step is repeated as previously described to create a multi layer image made up of black, yellow, magenta, and cyan toner particles as provided via each developing station 103*a*, 103*b*, 103*c* and 103*d*. It should be evident to one skilled in the art that the color of toner at each development station could be in a different arrangement.

After the multi layer image is created on the photoreceptive member, it is advanced to an intermediate transfer station where charging device 111 generates a charge for electrostatically transferring the image from the photoconductive belt 100 to an intermediate transfer member 110. The intermediate member 110 may be in the form of either a rigid roll or an endless belt, as shown in FIG. 2, having a path defined by a plurality of rollers in contact with the inner surface thereof. The intermediate member preferably comprises a multilayer structure comprising a substrate layer having a thickness greater than 0.1 mm and a resistivity of about $10^6$ ohm-cm and insulating top layer having a thickness less than 10 micron, a dielectric constant of approximately 10, and a resistivity of about $10^{13}$ ohm-cm. The top layer also has an adhesive release surface. It is also preferred that both layers have a similar hardness of less than about 60 durometer. Preferably, both layers are composed of Viton™ (a fluoroelastomer of vinylidene fluoride and hexafluoropropylene) which can be laminated together. The intermediate transfer member is typically dimensionally stable in nature for providing uniform image deposition which results in a controlled image transfer gap and better image registration.

The multi layer image on the intermediate transfer member 110 may be image conditioned in a manner similar to the image conditioning described hereinabove with respect to the developed image on the photoconductive belt 100 by means of a roller 120 which conditions the image by reducing fluid content while inhibiting the departure of toner particles from the image as well as compacting the toner image. Preferably, roller 120 conditions the multi layer image so that the image has a toner composition of more than 50 percent solids. In addition, the multi layer image present on the surface of the intermediate member may be transformed into a tackified or molten state by heat, as may be provided by a heating element 32. More specifically, heating element 32 heats both the external wall of the intermediate member and generally maintains the outer wall of member 110 at a temperature sufficient to cause the toner particles present on the surface to melt, due to the mass and thermal conductivity of the intermediate member. The toner particles on the surface maintain the position in which they were deposited on the outer surface of member 110, so as not to alter the image pattern which they represent while softening and coalescing due to the application of heat from the exterior of member 110. Thereafter, the intermediate transfer member continues to advance in the direction of arrow 22 to a transfix nip 34 where the tackified toner particle image is transferred, and bonded, to a recording sheet 26 with limited wicking thereby. At the transfix nip 34, the toner particles are forced into contact with the surface of recording sheet 26 by a normal force applied through backup pressure roll 36. Some of the advantages provided by the use of an intermediate transfer member include reduced heating of the recording sheet as a result of the toner or marking particles being pre-melted on the intermediate, as well as the elimination of an electrostatic transfer device for transferring charged particles to a recording sheet.

After the developed image is transferred to intermediate member 110, residual liquid developer material may remain on the photoconductive surface of belt 100. A cleaning station 31 is therefore provided, including a roller formed of any appropriate synthetic resin which may be driven in a direction opposite to the direction of movement of belt 100, to scrub the photoconductive surface clean. It will be understood, however, that a number of photoconductor cleaning devices exist in the art, any of which would be suitable for use with the present invention. In addition, any residual charge left on the photoconductive surface may be extinguished by flooding the photoconductive surface with light from lamp 34*d* in preparation for a subsequent successive imaging cycle. In this way, successive electrostatic latent images may be developed.

The foregoing discussion provides a general description of the operation of a liquid developing material based electrostatographic printing machine incorporating the development apparatus of the present invention therein. The detailed structure of the development apparatus will be described hereinafter with reference to FIGS. 1 and 2. It will be understood that the development system of the present invention may be utilized in a multicolor electrophotographic printing machine or, in a monocolor printing machine. The developed image may be transferred directly to the copy sheet or, as described, to an intermediate member prior to transfer to the copy sheet. Multicolor printing machines may use this type of development unit where successive latent images are developed to form a composite multicolor toner image which is subsequently transferred to a copy sheet or, in lieu thereof, single color liquid images may be transferred in superimposed registration with one another directly to the copy sheet.

Figure 1:
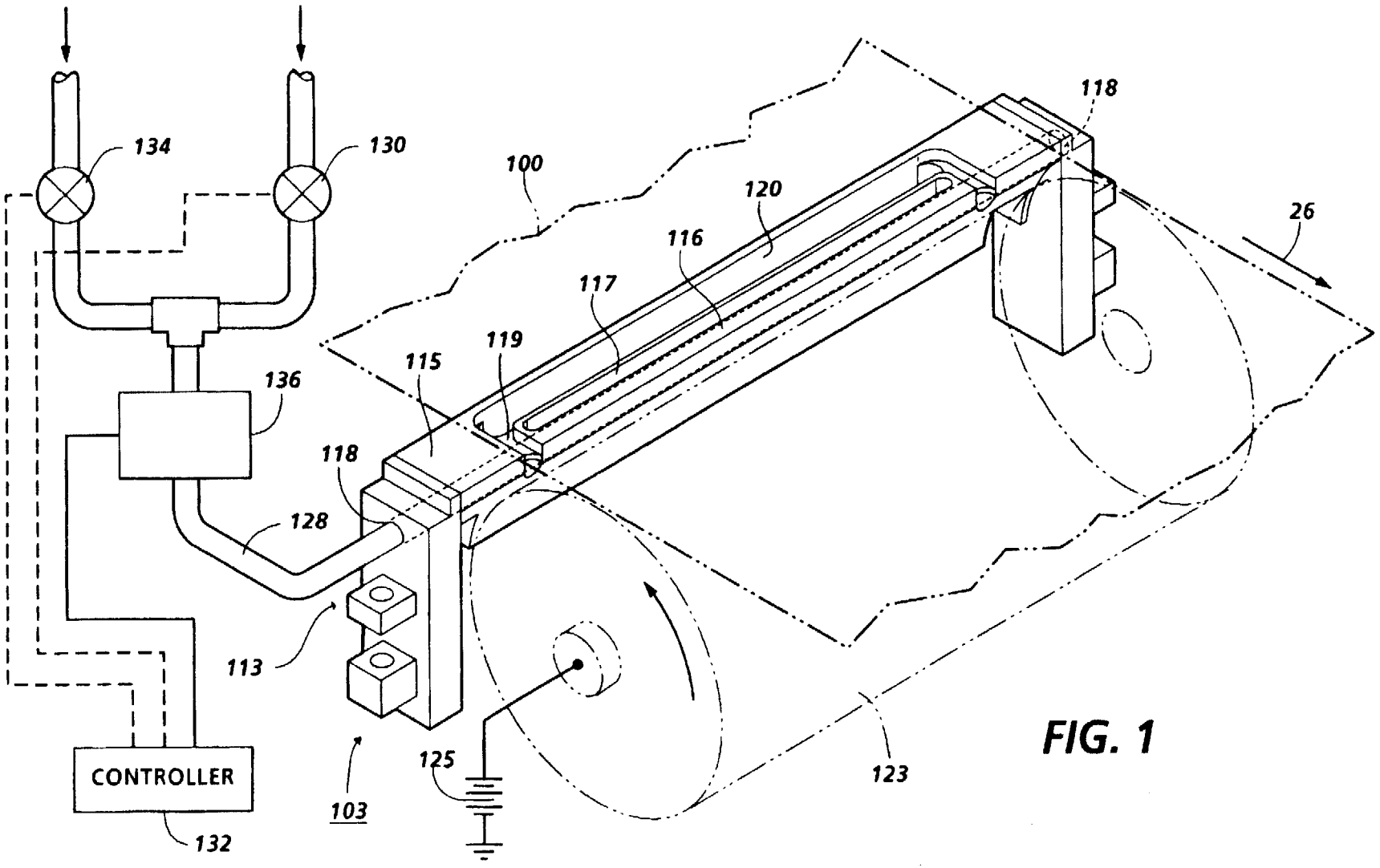
FIG. 1 is a perspective view of one embodiment of the liquid developing material applicator and the developing/metering apparatus of the present invention.

Referring now to FIGS. 1 and 2, a developer unit 103 including an developing material applicator 113 in accordance with the present invention will be described with an understanding that the developer units 103*a*, 103*b*, 103*c* and 103*d* shown and described in the apparatus of FIG. 3 are substantially identical thereto, In general, the only distinction between developer units is the color of the liquid developer material being used. As depicted in FIG. 1, the developer unit 103 includes an developing material applicator 113 and a metering roll 123 situated adjacent to one another and in close proximity to the surface of photoreceptive belt 100.

The liquid developing material applicator 113 of the present invention includes a housing 115 having a substantially planar surface 116 positioned opposite belt 100 and adjacent thereto. The housing 115 is of a single piece construction fabricated from a suitable nonconductive material such as a polycarbonate or other reinforced polymer based material, whereby fabrication and manufacturing can be accommodated by nonheavyduty machining or via plastic extrusion. The housing 115 also includes an elongated aperture 117 situated along a central portion of the planar surface and extending along a longitudinal axis of the housing so as to be oriented substantially transverse to the belt 100 along the direction of travel thereof, as indicated by arrow 26. The aperture 117 provides a path of travel for liquid developer material being transported therethrough and also defining a liquid developing material application region in which the liquid developing material can flow freely for contacting the liquid developer material with the surface of the photoreceptor belt 100. Coupled to the elongated aperture 117 are inlet ports 118, located at opposite ends of the elongated aperture 117. Liquid developer material is pumped through the inlet ports 118 and into the elongated aperture 117 such that the liquid developer material flows out of the elongated aperture 117 into contact with the surface of photoreceptor belt 100. An overflow drainage channel 119 partially surrounds the aperture 117 for collecting excess developer material which may not be transferred over to the photoreceptor surface. The overflow channel is connected to an outlet port 120 for removal of excess or extraneous liquid developer material and, preferably, for directing this excess material to a sump whereat the liquid developer material can be collected and recycled for subsequent use.

Slightly downstream of and adjacent to the developing material applicator 113, in the direction of movement of the photoreceptor surface 100, is an electrically biased developer roller 123, the peripheral surface thereof being situated in close proximity to the under surface of the photoreceptor 100. Preferably, the peripheral surface of the developer roller 123 is within about 50 to 75 microns (0.002 to 0.003 inches) from the surface of the photoreceptor 100. The developer 123 rotates in a direction opposite the movement of the photoconductor surface so as to provide a substantial shear force which is exerted on the toner and carrier liquid film in the area of the nip between the developer roller and the photoreceptor, for minimizing the thickness of the film of the developer liquid on the surface of the photoreceptor. This shear force removes a predetermined amount of the liquid developer material from the surface of the photoreceptor and transports the excess developer material in the direction of the developing material applicator. The excess developer material eventually falls away from the rotating metering roll for collection in the sump, as previously described. A DC power supply 125 is also provided for maintaining an electrical bias is maintained on the metering roll at a selected polarity such that image areas of the electrostatic latent image on the photoconductive surface attract toner for providing a developed latent image. This electrophoretic development process minimizes the existence of toner particles in background regions and maximizes toner deposition in image areas on the photoreceptor.

In printing operation, liquid developing material is pumped through inlet ports 118 into the elongated aperture 117. The developer material flows in the direction of the photoreceptor, filling the gap between the photoreceptor 100 and the planar surface 116 of liquid developing material applicator 113. As the belt 100 moves in the direction of arrow 26, a portion of the liquid developer material moves therewith in the direction of the metering roll 123. The metering roll is biased via the DC power supply 125, causing toner particles in the developer material to be attracted to the electrostatic latent image on the photoreceptor. The developing roller 123 also meters a predetermined amount of liquid developer material adhering to the photoconductive surface of belt 100 and acts as a seal for transporting the extraneous liquid developer material away from the photoreceptor.

During a clean mode of the present invention controller 132 turns off valve 130 which supplies liquid developing material to the applicator and turns on value 134 which supplies liquid carrier material to the applicator. Liquid carrier material is pumped through the inlet ports 118 and into the elongated aperture 117 such that the liquid carrier material flows out of the elongated aperture and onto developing roller 123. The flow of liquid carrier material removes residue liquid developer material away from liquid developing material applicator. Preferably, during the cleaning mode the flow rate of pump 136 is increased by controller 132 to facilitate removal residue liquid developer material. The overflow drainage channel 119 collects liquid carrier material whereat the liquid carrier material can be collected and recycled for subsequent use.

It is, therefore, apparent that there has been provided, in accordance with the present invention, a self cleaning liquid developing material applicator. This apparatus fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. An apparatus for developing an electrostatic latent image on an imaging member with a liquid developing material, comprising:

a liquid developing material applicator, a housing defining an aperture adapted for transporting liquid developing material into contact with the imaging member, said housing further including a planar surface adjacent the aperture for providing a liquid developing material application region in which the liquid developing material can flow freely with the imaging member;

a developing roll situated adjacent said liquid developing material applicator and downstream therefrom relative to a path of travel of the imaging member;

an electrical biasing circuit, to bias said developing roll for attracting the liquid developing material to image areas of the electrostatic latent image; and a cleaning system, operatively coupled to the liquid developing material applicator, for cleaning residue liquid developer material from said liquid developing material applicator and said developing roll.

* * * * *